US009206548B2

(12) United States Patent
Kujanpaa

(10) Patent No.: US 9,206,548 B2
(45) Date of Patent: Dec. 8, 2015

(54) COOLED SMELT RESTRICTOR AT COOLED SMELT SPOUT FOR DISRUPTING SMELT FLOW FROM THE BOILER

(71) Applicant: Andritz Inc., Glens Falls, NY (US)

(72) Inventor: Olli Kujanpaa, Marietta, GA (US)

(73) Assignee: Andritz Inc., Glens Falls, NY (US)

( * ) Notice: Subject to any disclaimer, the term of this patent is extended or adjusted under 35 U.S.C. 154(b) by 460 days.

(21) Appl. No.: 13/671,746

(22) Filed: Nov. 8, 2012

(65) Prior Publication Data

US 2013/0125998 A1 May 23, 2013

Related U.S. Application Data

(60) Provisional application No. 61/557,599, filed on Nov. 9, 2011.

(51) Int. Cl.

| | |
|---|---|
| ***F17D 1/20*** | (2006.01) |
| ***F17D 3/12*** | (2006.01) |
| ***D21C 11/12*** | (2006.01) |

(52) U.S. Cl.

CPC ..... *D21C 11/122* (2013.01); *Y10T 137/0324* (2015.04)

(58) Field of Classification Search

CPC ..... D21C 11/122; D21C 11/12
USPC ..... 137/340, 2; 162/30.1; 122/235.26
See application file for complete search history.

(56) References Cited

U.S. PATENT DOCUMENTS

| | | | | |
|---|---|---|---|---|
| 2,161,110 | A | | 6/1939 | Tomlinson et al. |
| 2,567,911 | A | | 9/1951 | Miller |
| 3,122,421 | A | | 2/1964 | Gettle |
| 3,358,623 | A | | 12/1967 | Lenz et al. |
| 4,011,047 | A | | 3/1977 | Tremblay |
| 4,280,982 | A | | 7/1981 | Shindome et al. |
| 4,421,596 | A | | 12/1983 | Hogberg |
| 4,659,020 | A | | 4/1987 | Kutrow |
| 4,706,324 | A | * | 11/1987 | Goodspeed ..... 15/246 |
| 5,545,292 | A | | 8/1996 | Empie |
| 5,635,095 | A | | 6/1997 | Kleinfeld |
| 5,976,319 | A | | 11/1999 | Paju et al. |
| 7,501,042 | B2 | | 3/2009 | Manttari |
| 7,806,127 | B2 | | 10/2010 | Gibowski |
| 7,988,820 | B2 | | 8/2011 | Tanttu et al. |
| 8,308,899 | B2 | | 11/2012 | Kujanpaa et al. |

FOREIGN PATENT DOCUMENTS

| | | |
|---|---|---|
| WO | 2007136889 A1 | 11/2007 |
| WO | 2008046959 A1 | 4/2008 |

OTHER PUBLICATIONS

European Search Report cited in PCT/US2012/064292 completed May 21, 2013.

* cited by examiner

*Primary Examiner* — John K Fristoe, Jr.
*Assistant Examiner* — Kevin Barss
(74) *Attorney, Agent, or Firm* — Kerri Hochgesang; Robert Joseph Hornung

(57) ABSTRACT

The amount or extent of expositions as a result of hot smelt from a pulp mill recovery boiler impacting cool liquid in a dissolving tank is reduced more effectively by regulating the smelt flow via a restrictor assembly. The restrictor assembly may be positioned to permit the smelt to flow, unrestricted, from the recovery boiler to the dissolving tank, or the restrictor assembly may be positioned so as to fully or partially block the smelt flow from the boiler to the dissolving tank. In some embodiments, a source of cooling fluid may be coupled to the restrictor assembly so as to assist in cooling parts of the restrictor assembly when hot smelt is in contact with the assembly.

20 Claims, 2 Drawing Sheets

COOLED SMELT RESTRICTOR AT COOLED SMELT SPOUT FOR DISRUPTING SMELT FLOW FROM THE BOILER

This application claims priority to U.S. Provisional Patent Application No. 61/557,599, filed Nov. 9, 2011, the entire disclosure of which is hereby incorporated herein by reference.

BACKGROUND

The present invention relates to controlling smelt flow through and from a smelt spout of a recovery boiler to a dissolving tank.

A recovery boiler, such as a soda recovery boiler, may be used in the chemical recovery of sulfate and other sodium-based substances from pulp manufacturing processes. In the recovery boiler, waste liquor, e.g., black liquor, from the pulping process is burned to transform cooking chemicals in the waste liquor into a form suitable for the recovery process.

The waste liquor from a sulfate pulping process typically includes sodium, sulfur, organic substances and other compounds. The sodium and sulfur may be recovered using a recovery boiler. The organic substances dissolved in the waste liquor during the pulping process, e.g., digestion, are combusted in the recovery boiler. The heat produced by the recovery boiler may be used to produce steam and to melt the inorganic compounds, e.g., sodium and sulfur. The melted inorganic compounds flow as a primarily liquid smelt to the bottom of the recovery boiler.

The smelt flows from the bottom of the recovery boiler along one or more cooled smelt spouts to a dissolving tank. In the dissolving tank, the smelt is dissolved by water or weak white liquor to produce soda lye, e.g., green liquor. The main components of the smelt in a sulfate process, and the green liquor produced from it, are often sodium sulfide and sodium carbonate. The smelt produced from recovery boilers receiving waste liquor from other processes may have inorganic compounds that differ from sodium sulfide and sodium carbonate. The green liquor produced in the dissolving tank may be transported to a causticizing plant for white liquor production.

The hot smelt flow from the spout causes "banging" and explosions when the smelt falls into the cooler liquid in the dissolving tank. The banging generally results from the large temperature differential between the smelt flow and the liquid in the dissolving tank. The temperature of the smelt is on the order of 750° Celsius (° C.) to 820° C. and the temperature of the green liquor (or weak white liquor) in the dissolving tank, containing mainly water, is on the order of 70° C. to 100° C. The dramatic temperature difference between the hot smelt flow and the much cooler liquor contributes to explosions and banging nose as the smelt hits and is instantly cooled by the liquor.

The intensity of the explosive reactions of the smelt in the dissolving tank may be reduced and controlled by disrupting the smelt flow. The disruption of the smelt flow may be to breakup a smelt stream into droplets or pieces as the stream flows from the spout and before the stream hits the liquid in the dissolving tank.

It is conventional to disrupt the smelt with jet streams, e.g., conduits or steam jets, discharged from nozzles at low or medium pressure steam. These nozzles are referred to as shatter jet nozzles because they shatter the flow of the smelt. The shatter jet nozzles typically discharge a jet stream at a specific volume and rate designed to break-up the smelt flow expected during normal operation of the recovery boiler. The smelt flows at a relatively uniform rate and volumetric flow during normal recovery boiler operation.

Variations can occur in the rate and volume of smelt flowing from a recovery boiler. During normal operation of the recovery boiler, the steam jets from the shatter jet nozzles are capable of disrupting the smelt flow and sufficiently reducing explosions in the dissolving tank. However, the recovery boiler may be operated in an "upset" condition resulting in abnormal or heavy smelt flows. These heavy smelt flows may not be adequately disrupted by the jets from the shatter jet nozzle and the smelt may cause explosions from which hot smelt droplets may splatter from the tank. These excessive explosions of smelt can result in equipment damage and danger to personnel safety.

SUMMARY OF INVENTION

A smelt restrictor has been conceived to disturb the smelt flow through a smelt spout such as to block or reduce a smelt flow. The restrictor may be coupled to spout hood with sources of steam (or other disrupting fluid) that provide cooling for the restrictor. Further, the blocking rate of the restrictor may be remotely controlled by controlling the position of the restrictor plate, such as by blocking stream only during heavy smelt flows, or during abnormal or "upset" operations. By controlling the restrictor position, the smelt discharge volume from the spout discharge may be adjusted to different rates of smelt flow. For example, the position of the restrictor may be in restricted (closed) position during heavy smelt flows from the boiler, and may be reopened during normal smelt flows, and the like.

A method, system and apparatus have been conceived for regulating the smelt flow at a smelt spout of a recovery boiler (e.g., in a cellulose pulp mill), utilizing at least a restrictor assembly comprising a restrictor plate. The smelt spout and a restrictor assembly may be cooled (e.g., by water or the like), so as to lower the temperature of the spout and restrictor assembly during periods of reduced or blocked smelt flow. The restrictor assembly and water-cooled smelt spout may advantageously control the flow rate and temperature of smelt discharged from a recovery boiler via the spout into a dissolving tank placed under the spout.

Thus, it may be desirable to improve the manner in which the flow of smelt is discharged from the smelt spout of a recovery boiler to the dissolving tank, and reduce the number of explosive reactions taking place in the dissolving tank. Accordingly, one skilled in the art may appreciate that there is a need for improved methods and apparatuses for controlling the flow rate and temperature of smelt flow from a recovery boiler into a dissolving tank via a smelt spout. This may advantageously help to reduce or control any reactions between the hot smelt flowing into the dissolving tank and the materials that are already in the dissolving tank. Certain example embodiments of the present invention seek to reduce explosions and other intense reactions between the hot smelt flowing into the dissolving tank and the lower-temperature materials already in the dissolving tank by implementing a restrictor apparatus/plate into or proximate to the smelt spout providing the pathway for smelt flow from the recovery boiler to the dissolving tank.

In order to achieve the advantages sought, certain example embodiments of the invention are disclosed herein which utilize a restrictor assembly comprising a restrictor plate disposed proximate a smelt spout, wherein the restrictor plate may fully or partially block smelt flow when necessary.

An apparatus for regulating a smelt flow from a recovery boiler to a dissolving tank, the apparatus comprising: a restrictor assembly disposed proximate a smelt spout, between the recovery boiler and the dissolving tank, wherein the restrictor assembly comprises at least a restrictor plate and an actuator for controlling a position of the restrictor plate, and wherein the restrictor plate is adapted to rotate between a first position and a second position, where the first position is such that the plate does not partially or substantially fully block the smelt flow traveling from the recovery boiler to the dissolving tank through the smelt spout, and wherein the second position is such that the plate partially or substantially fully blocks the smelt flow.

In another embodiment, an apparatus for regulating a smelt flow from a recovery boiler to a dissolving tank, the apparatus comprising: a restrictor assembly disposed proximate a smelt spout, between the recovery boiler and the dissolving tank, wherein the restrictor assembly comprises at least a restrictor plate and an actuator for controlling a position of the restrictor plate by causing the restrictor plate to be rotate about a fixed point; wherein the actuator is configured to control the position of the restrictor plate such that the actuator is configured to cause the restrictor plate to be rotated to a first position in which the plate does not block the smelt flow traveling along the smelt spout from the recovery boiler to the dissolving tank, and to a second position in which the plate at least partially blocks said smelt flow.

A method for restricting smelt flowing from a recovery boiler to a dissolving tank via a smelt spout, the method comprising: providing a restrictor assembly disposed proximate the smelt spout, between the recovery boiler and the dissolving tank, the restrictor assembly comprising at least a restrictor plate and an actuator for controlling the position of the restrictor plate; and controlling the position of the restrictor plate via the actuator such that the restrictor plate is in at least partial contact with the smelt so as to reduce a flow rate of the smelt from the recovery boiler to the dissolving tank.

BRIEF DESCRIPTION OF THE DRAWINGS

FIG. 2 is a schematic diagram of a showing a front view of the hood, smelt spout, actuator controlling a restrictor to block the smelt flow at the spout, wherein FIG. 2 is a view along line 2 in FIG. 1.

DETAILED DESCRIPTION OF THE INVENTION

Figure 1:
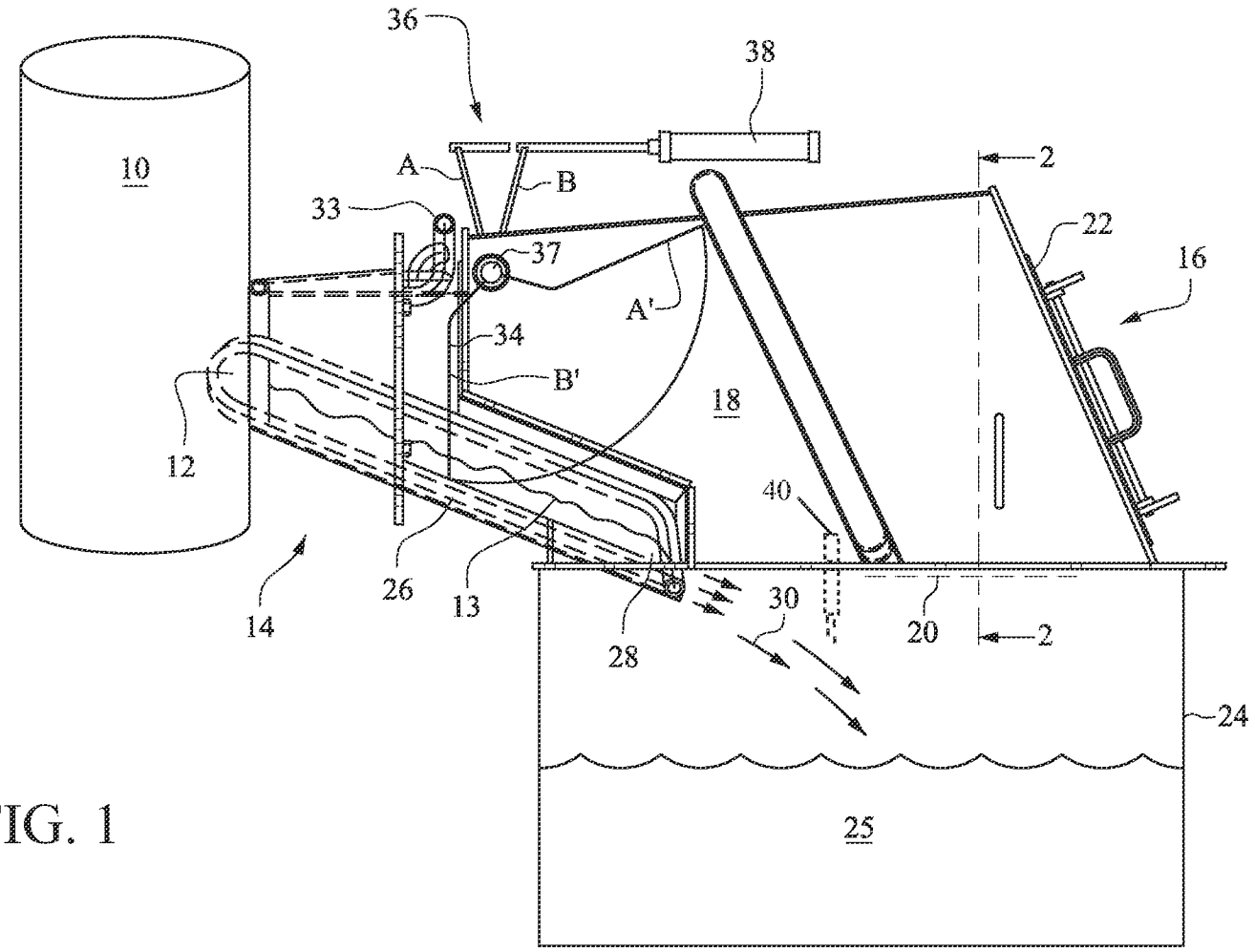
FIG. 1 is a is schematic diagram showing a side view, partially in cross-section, of a smelt hood, smelt spout, actuator controlling a restrictor to block the smelt flow at the spout.

Referring now more particularly to the accompanying drawings in which like reference numerals indicate like parts throughout the several views.

Figure 2:
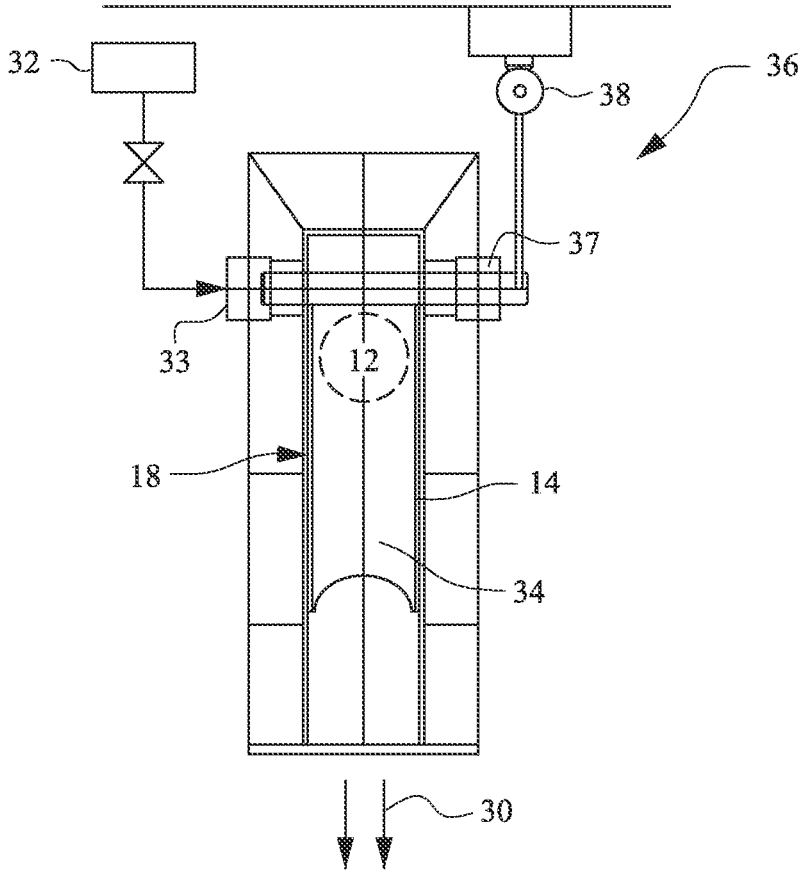

FIGS. 1 and 2 show a lower section of an example embodiment of a recovery boiler 10 of a pulp mill. Smelt flows from the bottom of the boiler 10 through an opening 12 and into a smelt spout 14. The portion of the smelt spout 14 extending outside the wall of the boiler is surrounded by a conventional closed protecting hood 16 comprising an upper hood portion 18 and a lower hood portion 20. The upper hood portion 18 includes a cover 22. The hood 16 contains the splash of liquid and smelt as they flow through the spout 14 and contains exhaust gases so that the gases do not discharge directly to the environment. The lower hood portion 20 may be connected to a conventional dissolving tank 24 disposed under the protecting hood 16. In the tank, the smelt is dissolved into liquid to produce, e.g., green liquor.

Hot, liquid smelt 13 flows from the opening 12 near the bottom of the boiler to the smelt spout 14 attached to the boiler. The smelt flows along a downwardly sloped bottom 26 of the spout 14, over free end 28 of the spout, and into the dissolving tank 24. The smelt flow path from the free end to the tank is indicated by arrows 30.

The restrictor assembly (indicated by 36) may be located above or proximate the smelt spout 14. The restrictor assembly may advantageously disrupt the smelt flow 13 in certain circumstances. For example, the restrictor assembly may disrupt the smelt flow 13 by reducing or substantially block the flow 13 from the recovery boiler 10 to the dissolving tank 24 via smelt spout 14.

The restrictor assembly may comprise restrictor plate 34, which may be attached to a mounting bracket 37, which in turn is fixed to the upper hood portion 18.

Mounting bracket 37 may be a fixed point, and may permit restrictor plate 34 to rotate about bracket 37 when the restrictor plate is moving from position A' to position B', or a position in between. The second position (e.g., Position B') though illustrated in FIG. 1 as substantially fully blocking the smelt flow, may in fact be any position along the axis of rotation between position A' and position B' as illustrated in FIG. 1. For example, the second position, or position B', may be any position along the curved line drawn between position A' and the substantially fully closed position.

The degree of rotation from the first position (e.g., position A' in FIG. 1) to the second position (e.g., position B' in FIG. 1, or a position along the axis of rotation between A' and the position in which the plate would substantially fully block smelt flow) may be greater than 90 degrees. However, if the restrictor plate is rotated to a second position where the smelt flow from the recovery boiler is only partially blocked, the degree of rotation may be less than 90 degrees.

The restrictor assembly may further comprise actuator 38. Actuator 38 may be connected to restrictor assembly 36, with extending linkage to control restrictor plate 34, such that restrictor plate 34 may be lowered in varying degrees so as to regulate the smelt flow 13 from opening 12 to the lower part of the smelt spout 14 (e.g., toward free end 28 of the smelt spout). Disrupting fluid source 32 (e.g., steam, or other disrupting fluid) may be coupled to the restrictor assembly 36 so as to cool the restrictor plate when it is partially or fully blocking the hot smelt stream 13 flowing down smelt spout 14.

The restrictor plate 34 may block all or part of the smelt flow 13 at downwardly sloped bottom 26 of the spout 14 as the smelt makes its way to the free end 28 of the spout. When restrictor plate 34 is in "smelt restricting position B'," the restrictor plate may block substantially all of the smelt flow 13 to the dissolving tank 24. Likewise, at "rest position A'," substantially all of the smelt flow 13 will continue from the recovery boiler to the dissolving tank. When restrictor plate 34 is positioned somewhere between rest position A' and restricting position B', the smelt flow may be reduced or controlled to varying extents. When the recovery boiler is "upset" or otherwise disrupted, and the flow of smelt 13 from the recovery boiler 10 is heavy or abnormal, the restricting plate 34 may be positioned so as to reduce the flow rate or amount of smelt 13 reaching the liquid level in the dissolving tank (or block the smelt flow entirely if necessary), in order to reduce loud, violent or dangerous reactions occurring in the dissolving tank 24 due to the temperature differential between the smelt flow 13 and the partially or fully dissolved materials 25 in the dissolving tank 24. In other exemplary embodiments, one or more shatter jet nozzles 40 may discharge a jet stream of low or medium pressure steam or other fluid at a specific volume to break up the smelt flow.

Turning back to the restrictor assembly 36, the actuator 38 may include extending linkage to control the restrictor plate 34, and may regulate the smelt flow to the lower part of the smelt spout 14. For example, when the restrictor plate 34 is in position A' as shown in FIG. 1, actuator 38 may be in position A. When restrictor plate 34 is in position B', actuator 38 may be in position B. Actuator control may be remote, e.g., twenty feet distant, from the protective hood 16 in some examples, and in other examples the actuator control may be proximate to the hood and controlled, for example, by a solenoid affixed to the valve. The restrictor plate 34 may be in the open position (e.g., rest position A') during normal operation of the recovery boiler, to provide free smelt flow 13.

The length of the restrictor assembly 36 is sufficient to position the restrictor plate 34 in a manner so as to fully block (if desired) the flow of smelt from the spout 14 into the liquid 25 in the dissolving tank 24. In "smelt restricting position B", the free end (e.g., the bottom end) of the restrictor plate will be proximate or in direct contact with the bottom (e.g., 26) of smelt spout 14. When the restrictor assembly is in position B, the smelt flow 13 will be substantially blocked. However, in some example embodiments, when the restrictor plate is positioned somewhere between positions A' and B', the smelt flow 13 may only be partially blocked. In these cases, the free end of the restrictor plate may be proximate to the bottom of the smelt spout, but may not be in direct contact with the bottom of the smelt spout.

The restrictor assembly is preferably mounted to or proximate the upper hood portion 18, so that the restrictor plate 34 may be turned and positioned properly (e.g., position A', position B', or somewhere in between) with respect to the smelt flow 13.

During operation of the recovery boiler 10, steam or other cooling/disrupting fluid may be available from a fluid source 32, such as a source of low pressure or medium pressure steam or compressed air. The pressurized fluid source 32 may provide cooling fluid to the restrictor assembly 36. For example, the fluid may be provided proximate the restrictor assembly via distribution system 33. However, this source 32 may be closed or throttled during normal operation, because cooling may not be needed for restrictor plate at rest position A' (e.g., when the restrictor plate is not in contact with the hot smelt flow). The cooling fluid may act as cooling media for restrictor plate 34, since restrictor plate 34 will be in direct contact with hot smelt stream 13 during restricting position B. The pressure of the optionally pressurized fluid from source 32 may be selected so as to adequately produce cooling for the restrictor plate.

The fluid from source 32 distributed via distribution system 33, e.g., a pipe having one or more holes through which fluid is expelled, may help to cool the restrictor plate 34 in contact with the smelt flow 13 during abnormal operation of the recovery boiler (e.g., when restrictor plate 34 is partially lowered or in smelt blocking position B). "Abnormal operation" of the recovery boiler may indicate the presence of excessive smelt flow 13 from the boiler 10 to dissolving tank 24. The smelt restrictor plate 34, when lowered partially or when lowered fully to smelt restricting position B, will limit or block smelt flow 13, as explained above. The fluid or restrictor plate 34 may be used during normal or abnormal operation of the recovery boiler.

The volume or flow rate of cooling fluid from the pressurized fluid source 32 to the assembly 36 may fully or partially cause the restrictor plate 34 to cool when the smelt flow 13 is reduced or blocked (e.g., when the higher temperature smelt flow is proximate or in direct contact with restrictor plate 34). Though cooling fluid is intended to cool restrictor plate 34, due to the cooling of the restrictor plate, the smelt flow 13 in contact with or proximate restrictor plate 34 may also experience a reduction in temperature. The combination of reduced smelt flow, and optionally the cooling of the restrictor plate 34 may advantageously reduce the reactions occurring in the dissolving tank due to the temperature differential or flow rate of the smelt flow from the recovery boiler into the dissolving tank. In other words, the restrictor assembly 36 and cooling for restrictor plate 34 may advantageously cool the smelt flow during abnormal boiler operation, and subsequently reduce the number or intensity of reactions occurring during smelt flow into the dissolving tank. The cooling system may be an optional feature of the restrictor assembly, for example and without limitation, such as when the restrictor plate or assembly is sacrificial or replaceable.

The apparatuses and methods disclosed herein may enable a safer and more efficient operation of the recovery boiler and dissolving tank, particularly, for example, during heavy smelt flows from a recovery boiler. For example, the restrictor assembly may reduce the number and extent of explosions in the dissolving tank, which may advantageously reduce the danger of operating or being proximate to the recovery boiler or dissolving tank. Furthermore, the noises due to the smelt entering the dissolving tank may be reduced, especially during heavy smelt flows.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

The invention claimed is:

1. An apparatus for regulating a smelt flow from a recovery boiler to a dissolving tank, the apparatus comprising:

a restrictor assembly disposed proximate a smelt spout, between the recovery boiler and the dissolving tank, wherein the restrictor assembly comprises at least a restrictor plate and an actuator for controlling a position of the restrictor plate, wherein a portion of the restrictor plate configured to restrict smelt flow is a continuous piece having an area defined by a first side opposite a second side and a height of the continuous piece, and wherein the restrictor plate is adapted to rotate between a first position and a second position, wherein the first position is such that the restrictor plate does not partially or substantially restrict the smelt flow to reduce a rate of the smelt flow traveling from the recovery boiler to the dissolving tank through the smelt spout, and wherein the second position is such that the area of the continuous piece of the restrictor plate fills a smelt spout area defined by a first wall of the smelt spout opposite a second wall of the smelt spout and a height of the continuous piece extending into the smelt spout to partially or substantially restrict the smelt flow to reduce the rate of smelt flow flowing through the smelt spout.

2. The apparatus of claim 1, further comprising a source of cooling fluid coupled to the restrictor assembly, and a valve in a fluid path of the cooling fluid wherein the valve regulates a flow of the cooling fluid from the source to the restrictor assembly.

3. The apparatus of claim 1, wherein the restrictor plate is in the second position when the smelt flow is heavier than a normal flow of smelt to the dissolving tank.

4. The apparatus of claim 1, wherein the restrictor plate is in the first position when the smelt flow is substantially normal.

5. The apparatus of claim 1, wherein the restrictor assembly further comprises a fixed point, about which the restrictor plate is configured to rotate when switching between the first position and the second position.

6. The apparatus of claim 5, wherein a rotation of the restrictor plate about the fixed point, from the first position to the second position, is a rotation of at least about 90 degrees.

7. The apparatus of claim 5, wherein a rotation of the restrictor plate about the fixed point, from the first position to the second position, is a rotation of less than about 90 degrees.

8. The apparatus of claim 1, wherein the restrictor assembly further comprises a shatter jet nozzle for disrupting smelt flowing from the recovery boiler.

9. The apparatus of claim 1 wherein the actuator is remotely operable to switch the restrictor plate between the first position and the second position.

10. An apparatus for regulating a smelt flow from a recovery boiler to a dissolving tank, the apparatus comprising:

a restrictor assembly disposed proximate a smelt spout, between the recovery boiler and the dissolving tank, wherein the restrictor assembly comprises at least a restrictor plate and an actuator for controlling a position of the restrictor plate by causing the restrictor plate to be rotated about a fixed point, wherein a portion of the restrictor plate configured to restrict smelt flow is a continuous piece having an area defined by a first side opposite a second side and a height of the continuous piece;

wherein the actuator is configured to control the position of the restrictor plate such that the actuator is configured to cause the restrictor plate to be rotated to a first position in which the restrictor plate does not restrict the smelt flow to reduce a rate of smelt flow traveling through the smelt spout from the recovery boiler to the dissolving tank, and to a second position in which the area of the continuous piece of the restrictor plate fills a smelt spout area defined by a first wall of the smelt spout opposite a second wall of the smelt spout and a height of the continuous piece extending into the smelt spout to at least partially restricts said smelt flow to reduce the rate of smelt flow flowing through the smelt spout.

11. The apparatus of claim 10, wherein the first position of the restrictor plate is at least about 90 degrees away from the second position of the restrictor plate when the restrictor plate is rotated about the fixed point.

12. The apparatus of claim 10, further comprising a cooling fluid source coupled to the restrictor assembly, wherein cooling fluid is released from a valve when the restrictor plate is in the second position.

13. The apparatus of claim 12, wherein cooling fluid is not released when the restrictor plate is in the first position.

14. A method for restricting smelt flowing from a recovery boiler to a dissolving tank via a smelt spout, the method comprising:

providing a restrictor assembly disposed proximate the smelt spout, between the recovery boiler and the dissolving tank, the restrictor assembly comprising at least a restrictor plate and an actuator for controlling a position of the restrictor plate, wherein a portion of the restrictor plate configured to restrict smelt flow is a continuous piece having an area defined by a first side opposite a second side and a height of the continuous piece; and controlling the position of the restrictor plate via the actuator such that the area of the continuous piece of the restrictor plate fills a smelt spout area defined by a first wall of the smelt spout opposite a second wall of the smelt spout and a height of the continuous piece extending into the smelt spout to such that the restrictor plate in at least partial contact with a smelt to reduces a flow rate of the smelt flowing through the smelt spout from the recovery boiler to the dissolving tank.

15. The method of claim 14, wherein a liquid in the dissolving tank is at a lower temperature than a temperature of the smelt; and wherein said reduction of said smelt flow rate at least partially reduces an amount or extent of explosions occurring in the dissolving tank between the smelt and the lower-temperature liquid in the dissolving tank.

16. The method of claim 14, wherein a source of cooling fluid is coupled to the restrictor assembly, and a valve in a fluid path of the cooling fluid regulates a flow of the cooling fluid from the source to the restrictor assembly.

17. The method of claim 16, wherein the valve in the fluid path of the cooling fluid is partially or fully open when the restrictor plate is in at least partial contact with the smelt.

18. The method of claim 16, wherein the valve in the fluid path of the cooling fluid is substantially closed when the restrictor plate is not in contact with the smelt.

19. The method of claim 14, wherein the restrictor assembly further comprises a first conduit for disrupting smelt flowing from the recovery boiler.

20. The method of claim 14, wherein the actuator is remotely operable so as to cause the restrictor plate to be rotated around a fixed point when switching between the first and second positions.

* * * * *